US006349650B1

(12) United States Patent
Brunn et al.

(10) Patent No.: US 6,349,650 B1
(45) Date of Patent: Feb. 26, 2002

(54) LAUNCHABLE FLAMELESS EXPULSION GRENADE

(76) Inventors: Michael Brunn; Jacob Kravel, both of 226 Newtown Rd., Plainview, NY (US) 11802

( * ) Notice: Subject to any disclaimer, the term of this patent is extended or adjusted under 35 U.S.C. 154(b) by 0 days.

(21) Appl. No.: 09/649,778

(22) Filed: Aug. 29, 2000

(51) Int. Cl.[7] ..... F42B 12/46
(52) U.S. Cl. ..... 102/368; 102/482
(58) Field of Search ..... 102/367–370, 102/482, 488

(56) References Cited

U.S. PATENT DOCUMENTS 3,188,954 A * 6/1965 Roach et al.
3,795,197 A * 3/1974 Levenson ..... 102/65
4,932,328 A * 6/1990 Pinkney et al. ..... 102/482
5,069,134 A 12/1991 Pinkney
6,250,226 B1 * 6/2001 Leichter et al. ..... 102/370

* cited by examiner

*Primary Examiner*—Peter M. Poon
*Assistant Examiner*—Kimberly S. Smith
(74) *Attorney, Agent, or Firm*—Myron Amer P.C.

(57) ABSTRACT

A tear gas grenade having a pressurized $CO_2$ container oriented with a top in the trajectory direction to a target area and in facing relation to a top-piercing component across a clearance of a tracking compartment therebetween, in the operation of which a fuel-produced gas expands to simultaneously urge the top-piercing component in descending movement puncturing the $CO_2$ container and also sealing the tracking compartment against venting of the fuel-produced gas and, after a time interval of contraction of the fuel-produced gas, the $CO_2$ pressure urges the top piercing component in ascending movement unblocking the puncture opening in a container top and also unsealing the tracking compartment, to thereby correlate the expulsive effect of the $CO_2$ to the time interval of the sealed contraction of the fuel-produced gas contributing to a tear gas consequence adjacent or in the target area.

1 Claim, 1 Drawing Sheet

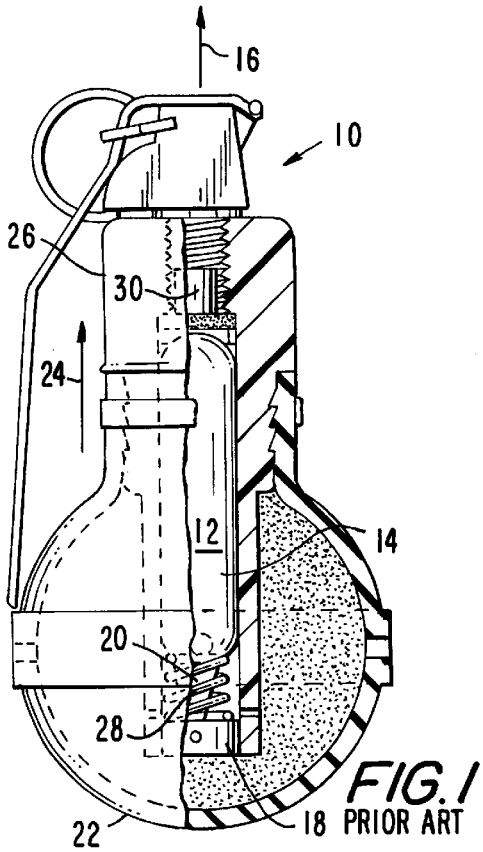
FIG. 1 PRIOR ART
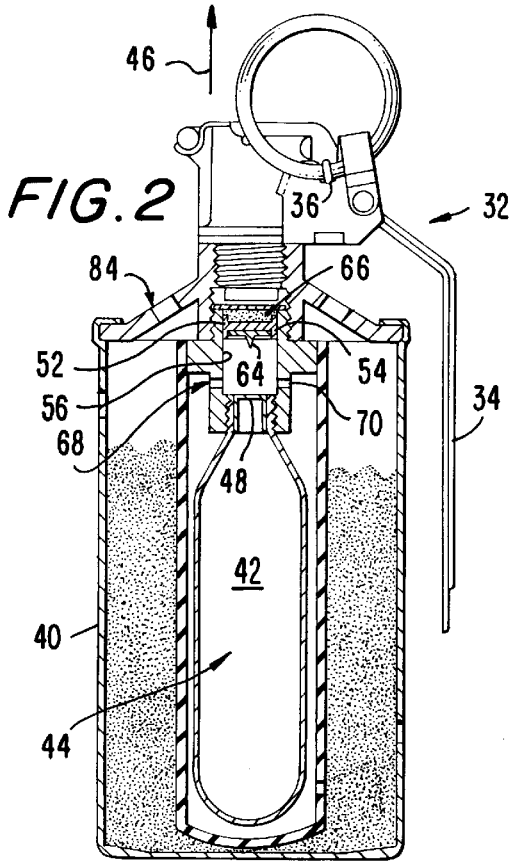
FIG. 2
FIG. 3
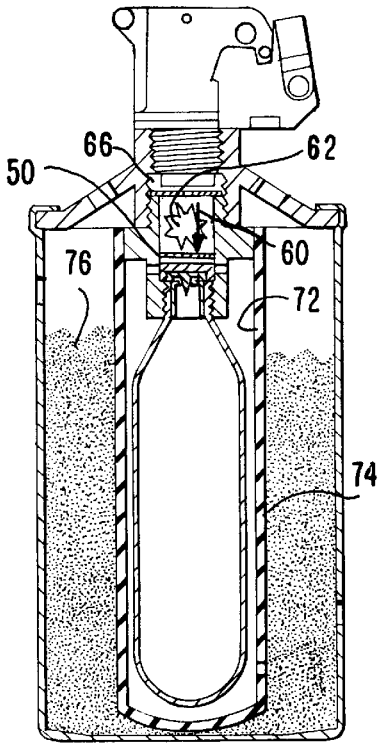
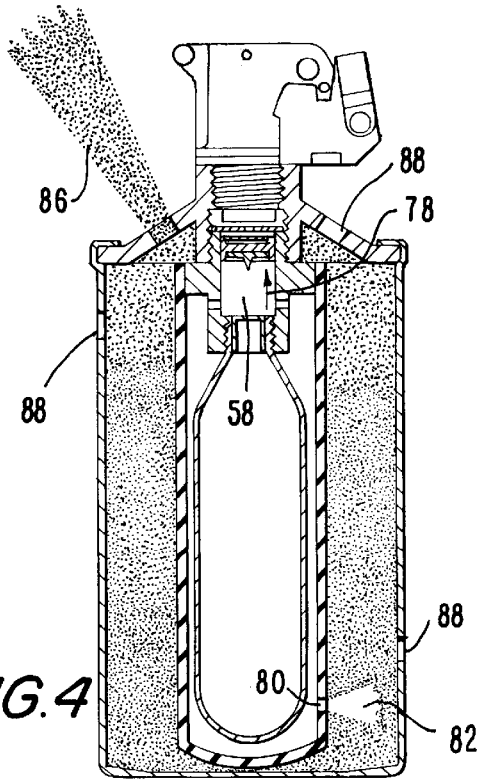
FIG. 4

LAUNCHABLE FLAMELESS EXPULSION GRENADE

The present invention relates generally to tear gas grenades and, more particularly, tear gas-type grenades using as the expulsive force compressed gas such as $CO_2$ which, unlike a pyrotechnic, is flameless and thus provides a correspondingly flameless use.

BACKGROUND OF THE INVENTION

Field of the Invention

The use of expulsive Carbon Dioxide ($CO_2$) tear gas grenades are well known because the expulsion is flameless due to the use of $CO_2$, as distinguished from a pyrotechnic expulsive fuel which burns hot and may shoot out white hot slag, one such flameless $CO_2$ tear gas grenade being that described and illustrated in U.S. Pat. No 5,069,134 for "Flameless Expulsive Grenade" issued to Pinkney on Dec. 3, 1991.

The '134 tear gas grenade and all other known similar grenades benefit from a flameless expulsion due to the use of $CO_2$ for the tear gas formulation which is normally in powder or liquid form, but in the absence of delicate handling prior to use and/or careful control during use, these grenades are vulnerable to premature release of the $CO_2$ and thus a tear gas consequence at an unwanted non-target area location.

SUMMARY OF THE INVENTION

Broadly, it is an object of the present invention to provide a flameless $CO_2$ tear gas grenade overcoming the foregoing and other shortcomings of the prior art.

More particularly, it is an object to release the $CO_2$ for its expulsive effect following a piercing of its storage container caused by use of an expanding and contracting pyrotechnic-produced gas, but under safe and controlled circumstances which maintains its flameless nature, and in which the gas expansion for container piercing and subsequently contraction for $CO_2$ release from the pierced container entails a time interval which obviates any premature tear gas consequence until completion of the trajectory of the grenade at the target area, all as will be better understood as the description proceeds.

BRIEF DESCRIPTION OF THE DRAWING

The description of the invention which follows, together with the accompanying drawings should not be construed as limiting the invention to the example shown and described, because those skilled in the art to which this invention appertains will be able to devise other forms thereof within the ambit of the appended claims.

FIG. 1 is a front elevational view, partially in longitudinal cross section, of a prior art grenade using pressurized carbon dioxide ($CO_2$) as the expulsive force to achieve a tear gas consequence at a target area;

FIGS. 2, 3 and 4 are front elevational views, in longitudinal cross section, illustrating in sequence an operating mode of a tear gas expulsive grenade addressing the problem of premature release of the $CO_2$ of the prior art and like grenades of FIG. 1, in which more particularly, FIG. 2 depicts the grenade prior to use;

FIG. 3 depicts the grenade at an initial location in its trajectory to a target area; and FIG. 4 depicts the grenade subsequently along its trajectory at a location adjacent its target area.

DESCRIPTION OF THE PREFERRED EMBODIMENT

As background, it is noted that tear gas grenades of the flammable or pyrotechnic type have been in use for some time. Pyrotechnic grenades include a fuel used to ignite tear gas pellets which produce a smoke that is expelled through ports in the grenades. A major drawback in using pyrotechnic grenades is that they burn quite hot and can readily start fires. Accordingly, their use is generally limited to locations where there is no fear of igniting combustible materials.

A tear gas grenade having a more desirable flameless explosive force instead of a pyrotechnic fuel uses pressurized carbon dioxide ($CO_2$) and in FIG. 1 is generally designated 10. The source 12 of the $CO_2$ is stored for use within a container 14 mounted in relation to the direction of launch or its trajectory 16, in an upside down orientation in which a bottom closure 18 of the container 14 is in a clearance position below a closure piercing component 20. In the pre-launch handling of the prior art grenade 10 inadvertent dropping of the unit on its base 22 or, even more significant, a sudden acceleration immediately after launch will cause movement 24 in the housing 26 not also occurring in the $CO_2$ container 14, due to its inertia and being held stationary in the housing 26 between spring 28 and rear positioning wad 30, which will cause premature piercing contact of the piercing component 20 with the bottom closure 18 and thus a corresponding premature release of the $CO_2$.

The problem of premature release of the $CO_2$ is addressed in the operating mode illustrated in sequence in FIGS. 2, 3 and 4 to which reference should now be made. The tear gas grenade, generally designated 32, preparatory to use, is held securely in hand and this results in a lever 34 being restrained by the palm of the hand. A safety pin 36 is removed by pulling on a ring 38 and the grenade 32 is thrown.

Once free, the lever 34 under spring urgency flies off and results in a sequence of occurrences, well understood in the munitions art of:

(1) allowing a striker to hit a primer that initiates a pyrotechnic delay column;

(2) after a prescribed delay (usually 1.5 seconds), a fuse shoots out white hot slag and flame into a baffle cavity;

(3) slag and flame emerging from a small hole in a baffle disc which ignites a propelling charge; and (4) the stock and expanding gasses from the ignited charge provide the operating mode in the grenade 32 which uses the pressurized $CO_2$ as the expulsive force in causing a tear gas consequence at a target area.

To advantageously use the aforesaid well known sequence of occurrences to obviate premature release of the $CO_2$ which provides the expulsive force for grenade 32, the grenade 32 is constructed, as will now be described in conjunction with FIGS. 2, 3 and 4, with significant differences noted from the construction of prior art tear gas grenades, as exemplified by grenade 10 of FIG. 1. More particularly, in the housing 40 of the grenade 32 there is provided a source 42 of pressurized $CO_2$ within a container 44 mounted, relative to its direction of launch 46, in a right-side up orientation, thereby positioning a top closure 48 of pierceable construction material, from which the container 44 is suspended in descending relation in the housing 40 in a clearance position below a piercing component 50, or in a reverse relationship of that of the prior art grenade 10 of FIG. 1.

Piercing component 50 has a circular disc-like body 52 sized to have a friction fit at the interface 54 of its peripheral edge and a cylindrical wall 56 bounding a tracking compartment 58 for the piercing component 50 during descending movement 60 from its clearance position above the container top closure 48, said descending movement 60 resulting under the urgency of expanding gas, depicted at 62, dislodging the piercing component from its friction fit 54 into piercing contact of its integral pointed projection 64 into the top closure 48. The expanding gas 62, in turn, is the result of ignition of a propelling pyrotechnic charge 66.

At the base of the tracking compartment cylindrical wall 56 are side venting openings 68 and 70 in communication via an external clearance 72 about the container 44 and spaced from a frangible latex or rubber membrane housing 74. Housing 74 protects the $CO_2$ container 44 and internal components from contamination and possible adverse effects of a payload 76 in the grenade housing 40, such as tear gas-producing powder or the like known to cause oxidation.

It will be noted that the piercing component 50 comes to a full stop against the container top closure 48 and in that position the disc body 52 closes the venting openings 68 and 70 thus preventing any flame or hot gases 62 from escaping through the venting openings 68 and 70 and having flow communication via the clearance 72 causing premature rupturing of the membrane housing 74.

As the gasses 62 above the piercing component 50 cool and contract, pressure above the piercing component subsides. Simultaneously, pressure released from the pierced $CO_2$ container 44 builds under the piercing component body 50 eventually forcing it to partake of ascending movement 78 unblocking venting openings 68 and 70 and resulting in the $CO_2$ pressure blowing through one or more membrane openings, such as opening 80, as depicted at 82, with the result of serving as an effective expulsive force expelling, as at discharge openings, such as opening 84, and as depicted at 86, as well as through additional openings 88, the tear gas powder 76.

In practice, it has been found that the sequence of events initiated by the fuse entails a time interval resulting in the grenade 32 being at a location in its trajectory which is adjacent its intended target area, thus obviating any adverse consequence as might occur upon premature release of the $CO_2$ being used as the expulsive force of the grenade.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A tear gas expulsion grenade using pressurized carbon dioxide comprising a housing, a source of pressurized carbon dioxide in a container with a top closure of pierceable construction material from which said container is mounted in descending relation in said housing, a said carbon dioxide container-piercing component in said housing disposed in a clearance position above said container top closure operatively mounted to be urged in descending movement into piercing contact with said carbon dioxide container top closure and in returning ascending movement to said clearance position, wall means bounding a tracking compartment for said opposite direction descending and ascending movement of said piercing component, said tracking compartment having vent openings adjacent a base thereof in communicating relation to said carbon dioxide container, and a propelling charge operatively effective to urge said piercing component in said descending movement with expanding gas and to permit said ascending movement thereof upon contracting of said gas, said piercing component having an operative position after an expanding gas-caused descent simultaneously causing a piercing of said carbon dioxide container top closure and closing said tracking compartment vent openings, whereby passage of released pressurized carbon dioxide is initially confined to said tracking compartment and only subsequently is in communication with said carbon dioxide through said opened vent openings.

* * * * *